US009309724B2

(12) United States Patent
Scott et al.

(10) Patent No.: US 9,309,724 B2
(45) Date of Patent: Apr. 12, 2016

(54) CUTTING ELEMENTS HAVING LATERALLY ELONGATED SHAPES FOR USE WITH EARTH-BORING TOOLS, EARTH-BORING TOOLS INCLUDING SUCH CUTTING ELEMENTS, AND RELATED METHODS

(71) Applicant: Baker Hughes Incorporated, Houston, TX (US)

(72) Inventors: Danny E. Scott, Montgomery, TX (US); Scott F. Donald, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 533 days.

(21) Appl. No.: 13/674,346

(22) Filed: Nov. 12, 2012

(65) Prior Publication Data

US 2013/0118813 A1 May 16, 2013

Related U.S. Application Data

(60) Provisional application No. 61/558,903, filed on Nov. 11, 2011.

(51) Int. Cl.
*E21B 10/46* (2006.01)
*E21B 10/56* (2006.01)
*E21B 10/567* (2006.01)

(52) U.S. Cl.
CPC ..... *E21B 10/46* (2013.01); *E21B 10/5673* (2013.01)

(58) Field of Classification Search
CPC .... E21B 10/46; E21B 10/567; E21B 10/5673
See application file for complete search history.

(56) References Cited

U.S. PATENT DOCUMENTS

| | | | | |
|---|---|---|---|---|
| 4,224,380 | A | | 9/1980 | Bovenkerk et al. |
| 4,662,896 | A | † | 5/1987 | Dennis |
| 4,883,132 | A | † | 11/1989 | Tibbitts |
| 5,127,923 | A | | 7/1992 | Bunting et al. |
| 5,421,423 | A | * | 6/1995 | Huffstutler ..... 175/374 |
| 5,558,170 | A | | 9/1996 | Thigpen et al. |
| 5,706,906 | A | * | 1/1998 | Jurewicz et al. ..... 175/428 |

(Continued)

FOREIGN PATENT DOCUMENTS

WO 92/14906 † 9/1992

OTHER PUBLICATIONS

"Varel, ChevronTexaco Commemorate Record", 1 page, published by The American Oil & Gas Reporter in Jul. 2004.†

(Continued)

*Primary Examiner* — Jennifer H Gay
(74) *Attorney, Agent, or Firm* — TraskBritt

(57) ABSTRACT

A cutting element for an earth-boring tool includes a volume of superabrasive material on a substrate. The cutting element has an elongated shape in a lateral dimension parallel to a front cutting face of the cutting element, and has a maximum lateral width in a first direction parallel to the front cutting face of the cutting element and a maximum lateral length in a second perpendicular direction parallel to the front cutting face of the cutting element. The maximum lateral length is significantly greater than the maximum lateral width. An earth-boring tool includes one or more such cutting elements mounted to a body of the earth-boring tool. A method of forming such an earth-boring tool includes selecting at least one such cutting element and mounting the cutting element to a body of an earth-boring tool.

17 Claims, 9 Drawing Sheets

(56) References Cited

U.S. PATENT DOCUMENTS

| | | | | |
|---|---|---|---|---|
| 5,971,087 | A * | 10/1999 | Chaves | 175/432 |
| 6,068,071 | A * | 5/2000 | Jurewicz | 175/432 |
| 6,808,031 | B2 * | 10/2004 | Mensa-Wilmot et al. | 175/434 |
| 6,904,983 | B2 * | 6/2005 | Thigpen et al. | 175/428 |
| 7,677,333 | B2 † | 3/2010 | Mensa-Wilmot | |
| 8,096,372 | B2 * | 1/2012 | Shen et al. | 175/331 |
| 8,839,889 | B2 * | 9/2014 | DiGiovanni et al. | 175/434 |
| 2004/0149495 | A1 * | 8/2004 | Thigpen et al. | 175/426 |
| 2007/0235230 | A1 * | 10/2007 | Cuillier et al. | 175/428 |
| 2007/0240905 | A1 * | 10/2007 | Mensa-Wilmot | 175/57 |
| 2008/0156545 | A1 * | 7/2008 | Tibbitts | 175/431 |
| 2008/0264696 | A1 * | 10/2008 | Dourfaye et al. | 175/428 |
| 2008/0296070 | A1 * | 12/2008 | Shen et al. | 175/421 |
| 2009/0008155 | A1 * | 1/2009 | Sherwood, Jr. | 175/431 |
| 2010/0089664 | A1 † | 4/2010 | Welch | |
| 2010/0243334 | A1 † | 9/2010 | Dourfaye | |
| 2011/0024201 | A1 * | 2/2011 | Scott et al. | 175/428 |
| 2011/0031035 | A1 * | 2/2011 | Stowe et al. | 175/430 |
| 2011/0266059 | A1 * | 11/2011 | DiGiovanni et al. | 175/57 |
| 2013/0068538 | A1 * | 3/2013 | DiGiovanni et al. | 175/432 |
| 2013/0118813 | A1 * | 5/2013 | Scott et al. | 175/432 |
| 2013/0213721 | A1 * | 8/2013 | Nilen et al. | 175/428 |

OTHER PUBLICATIONS

"Drillers mark record bit run", 1 page, published by Offshore Engineer in Jul. 2004.†

Lateral-Jet Hydraulics and Oval-Cutter Technology Combine to Improve PDC Performance, North Sea Scott Field, pp. 137-143, published by SPE Drilling & Completion in Jun. 1997.†

"Engineered solutions for hard & abrasive formations", 6 pages, released by Varel International in Jun. 2007.†

* cited by examiner
† cited by third party

CUTTING ELEMENTS HAVING LATERALLY ELONGATED SHAPES FOR USE WITH EARTH-BORING TOOLS, EARTH-BORING TOOLS INCLUDING SUCH CUTTING ELEMENTS, AND RELATED METHODS

CROSS-REFERENCE TO RELATED APPLICATION

This application claims the benefit of U.S. Provisional Patent Application Ser. No. 61/558,903, filed Nov. 11, 2011, in the name of Scott et al., the disclosure of which is hereby incorporated herein in its entirety by this reference.

FIELD

Embodiments of the present disclosure relate to cutting elements having extended shapes for use with earth-boring tools, to earth-boring tools including such cutting elements, and to methods of making and using such cutting elements and earth-boring tools.

BACKGROUND

Earth-boring tools are commonly used for forming (e.g., drilling and reaming) bore holes or wells (hereinafter "wellbores") in earth formations. Earth-boring tools include, for example, rotary drill bits, coring bits, eccentric bits, bicenter bits, reamers, underreamers, and mills.

Different types of earth-boring rotary drill bits are known in the art including, for example, fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore.

The drill bit is coupled, either directly or indirectly, to an end of what is referred to in the art as a "drill string," which comprises a series of elongated tubular segments connected end-to-end that extends into the wellbore from the surface of the formation. Often various tools and components, including the drill bit, may be coupled together at the distal end of the drill string at the bottom of the wellbore being drilled. This assembly of tools and components is referred to in the art as a "bottom hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft, to which the drill bit is attached, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore.

Fixed-cutter drill bits typically include a plurality of cutting elements that are attached to a face of bit body. The bit body may include a plurality of wings or blades, which define fluid courses between the blades. The cutting elements may be secured to the bit body within pockets formed in outer surfaces of the blades. The cutting elements are attached to the bit body in a fixed manner, such that the cutting elements do not move relative to the bit body during drilling. The bit body may be formed from steel or a particle-matrix composite material (e.g., cobalt-cemented tungsten carbide). In embodiments in which the bit body comprises a particle-matrix composite material, the bit body may be attached to a metal alloy (e.g., steel) shank having a threaded end that may be used to attach the bit body and the shank to a drill string. As the fixed-cutter drill bit is rotated within a wellbore, the cutting elements scrape across the surface of the formation and shear away the underlying formation.

The cutting elements used in such earth-boring tools often include polycrystalline diamond cutters (often referred to as "PCDs"), which are cutting elements that include a polycrystalline diamond (PCD) material. Such polycrystalline diamond cutting elements are formed by sintering and bonding together relatively small diamond grains or crystals under conditions of high temperature and high pressure in the presence of a catalyst (such as, for example, cobalt, iron, nickel, or alloys and mixtures thereof) to form a layer of polycrystalline diamond material on a cutting element substrate. These processes are often referred to as high temperature/high pressure (or "HTHP") processes. The cutting element substrate may comprise a cermet material (i.e., a ceramic-metal composite material) such as, for example, cobalt-cemented tungsten carbide. In such instances, the cobalt (or other catalyst material) in the cutting element substrate may be drawn into the diamond grains or crystals during sintering and serve as a catalyst material for forming a diamond table from the diamond grains or crystals. In other methods, powdered catalyst material may be mixed with the diamond grains or crystals prior to sintering the grains or crystals together in an HTHP process.

Upon formation of a diamond table using an HTHP process, catalyst material may remain in interstitial spaces between the grains or crystals of diamond in the resulting polycrystalline diamond table. The presence of the catalyst material in the diamond table may contribute to thermal damage in the diamond table when the cutting element is heated during use due to friction at the contact point between the cutting element and the formation. Polycrystalline diamond cutting elements in which the catalyst material remains in the diamond table are generally thermally stable up to a temperature of about 750° Celsius, although internal stress within the polycrystalline diamond table may begin to develop at temperatures exceeding about 350° Celsius. This internal stress is at least partially due to differences in the rates of thermal expansion between the diamond table and the cutting element substrate to which it is bonded. This differential in thermal expansion rates may result in relatively large compressive and tensile stresses at the interface between the diamond table and the substrate, and may cause the diamond table to delaminate from the substrate. At temperatures of about 750° Celsius and above, stresses within the diamond table may increase significantly due to differences in the coefficients of thermal expansion of the diamond material and the catalyst material within the diamond table itself. For example, cobalt thermally expands significantly faster than diamond, which may cause cracks to form and propagate within the diamond table, eventually leading to deterioration of the diamond table and ineffectiveness of the cutting element.

In order to reduce the problems associated with different rates of thermal expansion in polycrystalline diamond cutting elements, so-called "thermally stable" polycrystalline diamond (TSD) cutting elements have been developed. Such a thermally stable polycrystalline diamond cutting element may be formed by leaching the catalyst material (e.g., cobalt) out from interstitial spaces between the diamond grains in the diamond table using, for example, an acid. All of the catalyst material may be removed from the diamond table, or only a portion may be removed. Thermally stable polycrystalline diamond cutting elements in which substantially all catalyst material has been leached from the diamond table have been reported to be thermally stable up to a temperatures of about 1200° Celsius. It has also been reported, however, that such fully leached diamond tables are relatively more brittle and vulnerable to shear, compressive, and tensile stresses than are non-leached diamond tables. In an effort to provide cutting elements having diamond tables that are more thermally stable relative to non-leached diamond tables, but that are also relatively less brittle and vulnerable to shear, compressive, and tensile stresses relative to fully leached diamond tables, cutting elements have been provided that include a diamond table in which only a portion of the catalyst material has been leached from the diamond table.

As the cutting elements of an earth-boring tool wear during use, what is referred to in the art as a "wear scar" or "wear flat" develops on the cutting element. The area of the wear scar on previously known cutting elements increases with continued wear of the cutting element. As the wear scars of the cutting elements increases, the so-called "weight-on-bit" or "WOB" required to achieve any particular depth-of-cut (DOC) into the formation also increases. Eventually, the drilling system may be unable to provide a WOB sufficient to maintain a DOC needed for efficient drilling. At this point, the cutting elements and earth-boring tool are considered dull and replaced with another earth-boring tool having unworn or less worn sharp cutting elements.

BRIEF SUMMARY

In some embodiments, the present disclosure includes a cutting element for an earth-boring tool. The cutting element includes a substrate, and a volume of superabrasive material on an end of the substrate. An exposed surface of the superabrasive material defines a front cutting face of the cutting element. The cutting element has an elongated shape in a lateral dimension parallel to the front cutting face of the cutting element, and has a maximum lateral width in a first direction parallel to the front cutting face of the cutting element and a maximum lateral length in a second direction parallel to the front cutting face of the cutting element. The second direction is perpendicular to the first direction. The maximum lateral length is at least about two times the maximum lateral width.

In additional embodiments, the present disclosure includes an earth-boring tool having a body and at least one cutting element mounted to the body. The at least one cutting element includes a substrate and a volume of superabrasive material on an end of the substrate. An exposed surface of the superabrasive material defines a front cutting face of the at least one cutting element. The at least one cutting element has an elongated shape in a lateral dimension parallel to the front cutting face of the at least one cutting element, and has a maximum lateral width in a first direction parallel to the front cutting face of the at least one cutting element and a maximum lateral length in a second direction parallel to the front cutting face of the at least one cutting element. The second direction is perpendicular to the first direction. The maximum lateral length is at least about two times the maximum lateral width.

In yet further embodiments, the present disclosure includes a method of forming an earth-boring tool in which at least one cutting element is selected that includes a substrate and a volume of superabrasive material on an end of the substrate. An exposed surface of the superabrasive material defines a front cutting face of the cutting element. The at least one cutting element has an elongated shape in a lateral dimension parallel to a front cutting face of the at least one cutting element, and has a maximum lateral width in a first direction parallel to the front cutting face of the at least one cutting element and a maximum lateral length in a second direction parallel to the front cutting face of the at least one cutting element. The second direction is perpendicular to the first direction. The maximum lateral length is at least about two times the maximum lateral width. After selecting at least one such cutting element, the at least one cutting element is mounted to a body of the earth-boring tool.

BRIEF DESCRIPTION OF THE DRAWINGS

While the specification concludes with claims particularly pointing out and distinctly claiming what are regarded as embodiments of the disclosure, various features and advantages of this disclosure may be more readily ascertained from the following description of example embodiments provided with reference to the accompanying drawings, in which:

DETAILED DESCRIPTION

The illustrations presented herein are not actual views of any particular earth-boring tool, cutting element, or component thereof, but are merely idealized representations that are employed to describe embodiments of the present disclosure.

As used herein, the term "earth-boring tool" means and includes any tool used to remove formation material and form a bore (e.g., a wellbore) through the formation by way of the removal of the formation material. Earth-boring tools include, for example, rotary drill bits (e.g., fixed-cutter or "drag" bits and roller cone or "rock" bits), hybrid bits including both fixed cutters and roller elements, coring bits, percussion bits, bi-center bits, reamers (including expandable reamers and fixed-wing reamers), and other so-called "hole-opening" tools.

Embodiments of the present disclosure include cutting elements having shapes configured such that, as the cutting elements wear during use, the size of the wear scar on the cutting elements reaches and is maintained at a maximum area with continued wear of the cutting element, which allows continued use of the cutting elements with further wear without requiring increasing weigh-on-bit (WOB) to maintain a given depth-of-cut (DOC). Additional embodiments include earth-boring tools including such cutting elements, and methods of making such cutting elements and earth-boring tools.

Figure 1A:
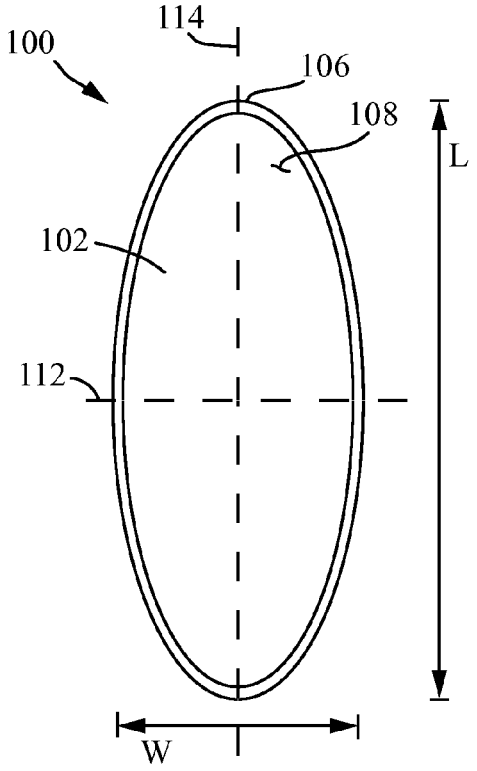
FIG. 1A is a front plan view of an embodiment of a cutting element.
Figure 1B:
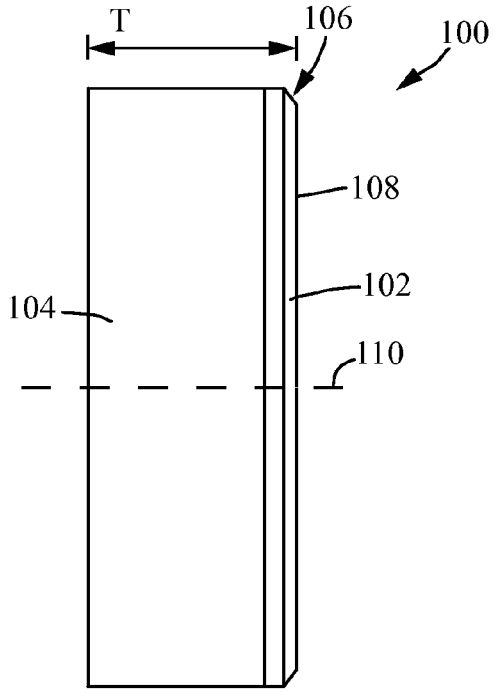
FIG. 1B is a side plan view of the cutting element of FIG. 1A.

FIGS. 1A and 1B illustrate a cutting element 100 for use on an earth-boring tool. The cutting element 100 has an elongated shape in a lateral dimension parallel to the front cutting face 108 of the cutting element 100, as discussed in further detail below. In some embodiments, the cutting element 100 may comprise a volume of polycrystalline superabrasive material 102, such as polycrystalline diamond or polycrystalline cubic boron nitride, which is formed on or attached to a an end of a substrate 104. The polycrystalline superabrasive material 102 may include a plurality of inter-bonded grains of hard material such as diamond or cubic boron nitride. The inter-bonded grains may be directly bonded together by direct atomic bonds formed using a high temperature, high pressure (HTHP) sintering process. Thus, the cutting element 100 may comprise a polycrystalline diamond compact (PDC) cutting element in some embodiments, and the polycrystalline superabrasive material 102 may comprise polycrystalline diamond (PCD) material. The PCD material may be formed by sintering and bonding together relatively small diamond grains or crystals in an HTHP sintering process in the presence of a catalyst (such as, for example, cobalt, iron, nickel, or alloys and mixtures thereof) to form a layer of polycrystalline diamond material on a cutting element substrate 104. The cutting element substrate 104 may comprise a cermet material (i.e., a ceramic-metal composite material) such as, for example, cobalt-cemented tungsten carbide. In such instances, the cobalt (or other catalyst material) in the cutting element substrate 104 may be drawn into the diamond grains or crystals during sintering and serve as a catalyst material for forming the diamond table from the diamond grains or crystals. In other methods, powdered catalyst material may be mixed with the diamond grains or crystals prior to sintering the grains or crystals together in an HTHP process.

Optionally, metal solvent catalyst material or any other material in the interstitial spaces between the inter-bonded grains of hard material in the superabrasive material 102 may be removed using, for example, an acid leaching process. Specifically, as known in the art and described more fully in U.S. Pat. No. 5,127,923 and U.S. Pat. No. 4,224,380, the disclosures of which are incorporated herein in their entirety by this reference, aqua regia (a mixture of concentrated nitric acid ($HNO_3$) and concentrated hydrochloric acid (HCl)) may be used to at least substantially remove metal solvent catalyst material or any other material from the interstitial voids between the inter-bonded grains of hard material in the superabrasive material 102. It is also known to use boiling hydrochloric acid (HCl) and boiling hydrofluoric acid (HF).

As known in the art, a peripheral edge of a front cutting face 108 of the cutting element 100 may form a cutting edge 106 of the cutting element 100. An exposed major surface of the superabrasive material 102 may define the front cutting face 108 of the cutting element 100. The front cutting face 108 may be planar in some embodiments. When the cutting element 100 is mounted on an earth-boring tool and used to cut subterranean formation material, the cutting element 100 may be oriented such that the cutting edge 106 of the cutting element 100 scrapes against and shears away formation cuttings. One or more straight or curved chamfer surfaces may be present at the cutting edge 106 and provide a transition between the front cutting face 108 of the cutting element 100 and the lateral side surfaces of the cutting element 100.

In accordance with embodiments of the disclosure, the cutting element 100 is elongated in a lateral dimension. Referring to FIG. 1B, as used herein, the term "lateral dimension" means and includes any dimension generally perpendicular to a line 110 (FIG. 1B) normal (i.e., perpendicular) to the front cutting face 108 of the cutting element 100. For example, as shown in FIG. 1A, the dimensions of the cutting element 100 along the perpendicular lines 112 and 114 are lateral dimensions of the cutting element 100. In particular, the cutting element 100 has a maximum lateral width W in the lateral dimension parallel to the line 112 and a maximum lateral length L in the lateral dimension parallel to the line 114. The maximum lateral width W is in a dimension perpendicular to the maximum lateral length L. As shown in FIG. 1A, the maximum lateral length L of the cutting element 100 is significantly greater than the maximum lateral width W of the cutting element 100. Thus, the cutting element 100 is elongated in the lateral dimension extending parallel to the line 114.

In accordance with some embodiments, the cutting element 100 may have a maximum lateral length L that is at least about two (2) times greater than the maximum lateral width W of the cutting element 100, at least about three (3) times greater than the maximum lateral width W of the cutting element 100, or even at least about five (5) times greater than the maximum lateral width W of the cutting element 100. As shown in FIG. 1B, the cutting element 100 also has a thickness T measured in dimensions parallel to the line 110 normal to the front cutting face 108 of the cutting element 100. The thickness T may be less than the maximum lateral length L of the cutting element 100, and may be greater than, equal to, or less than the maximum lateral width W of the cutting element 100.

As non-limiting example embodiments, the maximum lateral width W of the cutting element 100 may be between about five millimeters (5 mm) and about twenty millimeters (20 mm), between about five millimeters (5 mm) and about fifteen millimeters (15 mm), or even between about five millimeters (5 mm) and about ten millimeters (10 mm), and the maximum lateral length L of the cutting element 100 may be between about ten millimeters (10 mm) and about one hundred millimeters (100 mm). The thickness T of the cutting element 100 may be between about five millimeters (5 mm) and about twenty millimeters (20 mm).

Figure 2:
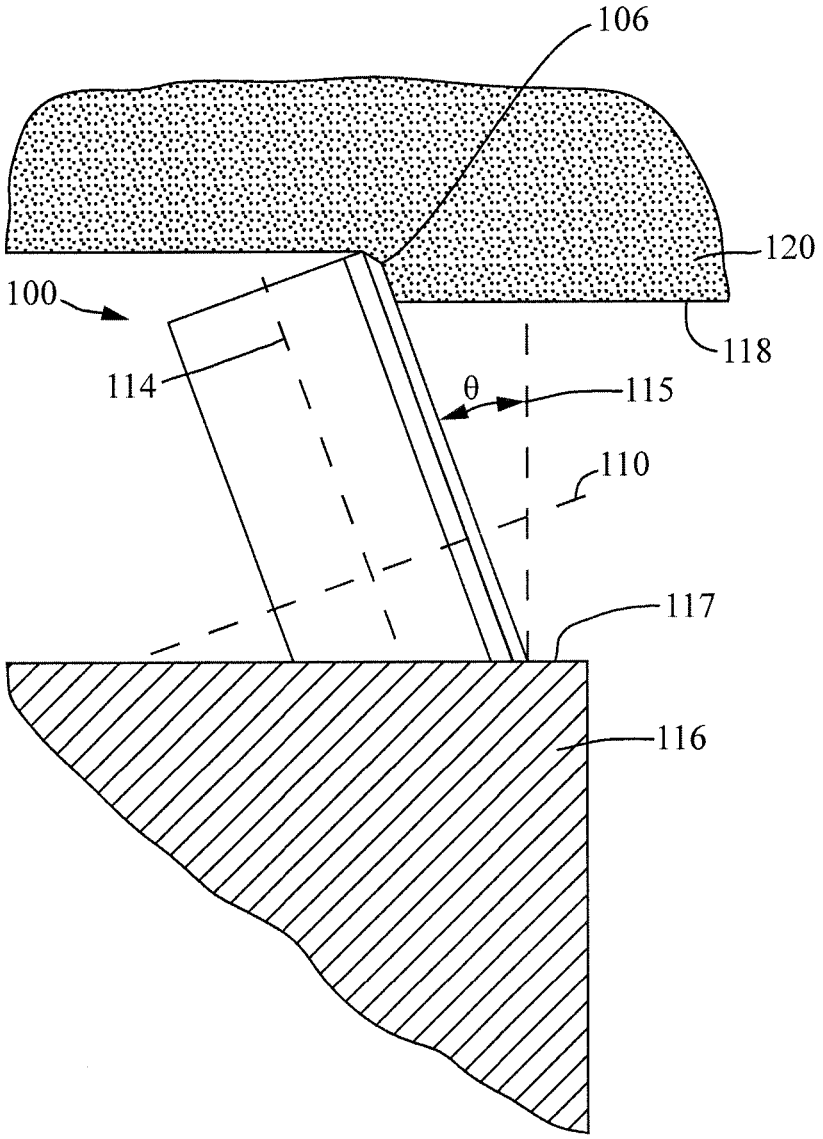
FIG. 2 is a simplified schematic illustration of the cutting element of FIGS. 1A and 1B mounted on a blade of an earth-boring tool and cutting a subterranean formation.

FIG. 2 illustrates the cutting element 100 mounted to a body 116 of an earth-boring tool. For example, the body 116 may comprise a blade of a fixed-cutter earth-boring rotary drill bit, such as that described in further below with reference to FIG. 11. The cutting element 100 may be secured to the body 116 partially within a pocket formed in the body 116 by, for example, brazing or otherwise bonding the cutting element 100 to the body 116. As shown in FIG. 2, in some embodiments, the cutting element 100 may be mounted on the body 116 such that the cutting element 100 is oriented at a rake angle θ relative to a line 115 normal to the surface 117 of the body 116 surrounding the cutting element 100. The rake angle θ may be positive, as shown in FIG. 2, such that the cutting element 100 is oriented at a so-called "back rake" angle θ relative to the surface 118 of the subterranean formation 120 being cut by the cutting element 100. In other embodiments, the rake angle θ may be zero, such that the line 114 is oriented at least substantially normal to the surface 118 of a subterranean formation 120 being cut. In yet further embodiments, the rake angle θ may be negative, such that the such that the cutting element 100 is oriented at a so-called "forward rake" angle θ relative to the surface 118 of the subterranean formation 120 being cut by the cutting element 100.

As shown in FIG. 2, the cutting element 100 may be mounted on the body 116 such that the maximum lateral width W of the cutting element 100 (FIG. 1A), which extends along the line 112, is oriented generally parallel to the surface 117 of the body 116 adjacent the cutting element 100, and such that the maximum lateral length L of the cutting element 100 (FIG. 1A), which extends along the line 114, is oriented generally transverse to the surface 117 of the body 116 adjacent the cutting element 100 (although the maximum lateral length L and the line 114 may be oriented at an acute angle to a line 115 perpendicular to the adjacent surface 117 of the body 116 due to the rake angle θ at which the cutting element 100 is oriented on the body 116). In this configuration, the cutting element 100 is relatively elongated or extended in the direction extending outward from the surface 117 of the body 116 along the maximum lateral length L (FIG. 1A) of the cutting element 100, and the cutting element 100 is relatively narrow in the lateral directions extending parallel to the surface 117 of the body 116 (and the surface 118 of the subterranean formation 120 being cut using the cutting element 100) along the maximum lateral width W (FIG. 1A) of the cutting element 100.

Figure 3A:
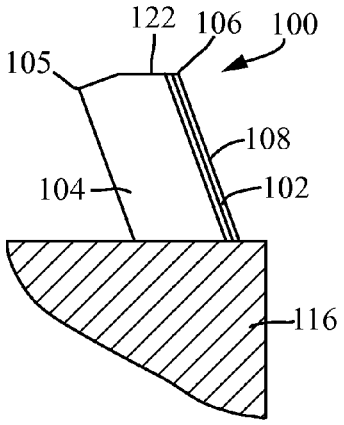
FIG. 3A illustrates the cutting element of FIGS. 1A and 1B mounted on the blade of the earth-boring tool as shown in FIG. 2 in a first worn state after a first amount of wear of the cutting element and formation of a wear flat on the cutting element.
Figure 3B:
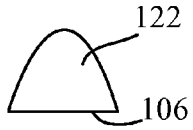
FIG. 3B is a plan view of the wear flat on the cutting element in the worn state shown in FIG. 3A.

FIG. 2 illustrates the cutting element 100 in a new unworn state with a sharp cutting edge 106. As previously discussed, as the cutting element 100 is used to cut formation material, the cutting element 100 will begin to wear, and a wear flat will develop on the cutting element 100. FIGS. 3A and 3B, 4A and 4B, and 5A and 5B illustrate the progression of a wear flat 122 (e.g. wear scar) on the cutting element 100 as the cutting element 100 wears during use. FIG. 3A is a side view of the cutting element 100 mounted to the body 116 of an earth-boring tool like that illustrated in FIG. 2. As shown in FIG. 3A, a wear flat 122 has developed on the radially outward side of the cutting element 100 from the body 116. A plan view of the wear flat 122 is shown in FIG. 3B. After formation of the wear flat 122, the cutting edge 106 of the cutting element 100 comprises a substantially linear edge extending across the leading side of the wear flat 122 along the intersection of the wear flat 122 and the front cutting face 108 of the superabrasive material 102. In the worn state shown in FIGS. 3A and 3B, the wear flat 122 has not yet reached and intersected an edge 105 of a back surface of the substrate 104 opposite the side on which the superabrasive material 102 is disposed. As the cutting element 100 continues to wear, the size of the area of the wear flat 122 will increase in the lateral dimension and vertical dimension from the perspective of FIG. 3B.

Figure 4A:
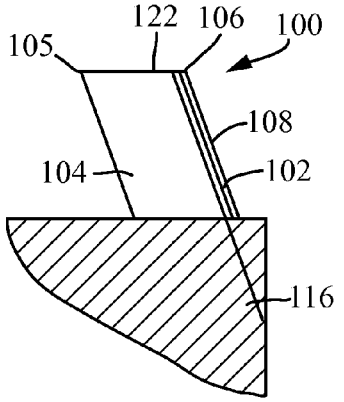
FIG. 4A is similar to FIG. 3A and illustrates the cutting element in a second worn state after further wear of the cutting element.
Figure 4B:
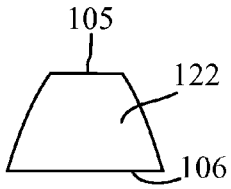
FIG. 4B is a plan view of the wear flat on the cutting element in the worn state shown in FIG. 4A.
Figure 5A:
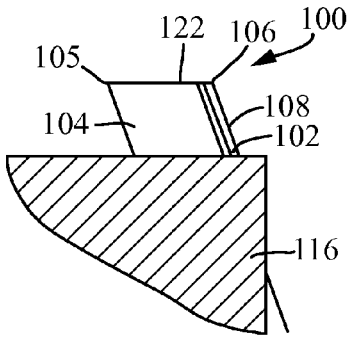
FIG. 5A is similar to FIGS. 3A and 4A and illustrates the cutting element in a third worn state after yet further wear of the cutting element.
Figure 5B:
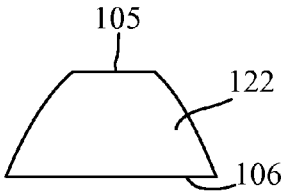
FIG. 5B is a plan view of the wear flat on the cutting element in the worn state shown in FIG. 5A.

FIG. 4A and FIG. 4B illustrate the cutting element 100 in a further worn state after the wear flat 122 has intersected the edge 105 of a back surface of the substrate 104 opposite the side on which the superabrasive material 102 is disposed. As can be seen by comparison of FIG. 4B with FIG. 3B, the size of the area of the wear flat 122 is larger in FIG. 4B than in FIG. 3B. As shown in FIG. 4B, the wear flat 122 extends from the cutting edge 106 to the edge 105 of the back surface of the substrate 104. As the cutting element 100 continues to wear, the size of the wear flat 122 cannot increase in the vertical dimension from the perspective of FIG. 4B, as the wear flat 122 extends to the edge 105. The size of the wear flat 122 may increase in the horizontal dimension from the perspective of FIG. 4B with further wear, due to the arcuate contour of the lateral side surfaces of the cutting element 100. For example, FIGS. 5A and 5B illustrate the cutting element 100 after yet further wear. As can be seen by comparison of FIG. 5B with FIG. 4B, the size of the area of the wear flat 122 is larger in FIG. 5B than in FIG. 4B, since the thickness of the wear flat 122 has increased in the lateral dimension from the perspective of the figures.

As previously discussed, in previously known drill bits and other earth-boring tools, as the cumulative area of the wear flats 122 of all cutting elements 100 on the drill bit or other tool increases, the amount of weight-on-bit required to maintain any given depth-of-cut also increases. For previously known drill bits and other tools, the cumulative area of the wear flats 122 will reach a level at which the weight-on-bit becomes too high to maintain any significant depth-of-cut, and, hence, the drill bit or other tool cannot cut formation material efficiently and may be characterized as a dull bit.

In accordance with embodiments of the present disclosure, the extended geometries of cutting elements 100 as described herein may be selectively tailored such that the size of the wear scar area (i.e., the area of the wear scar 122) increases as a function of linear wear distance at a relatively low rate. As used herein, the phrase linear wear distance means the linear distance the cutting edge 106 on the wear flat 122 has moved along the cutting face 108 from the initial point of contact of the cutting edge 106 with the formation 120 in the initial, unworn and sharp state shown in FIG. 2.

Figure 6:
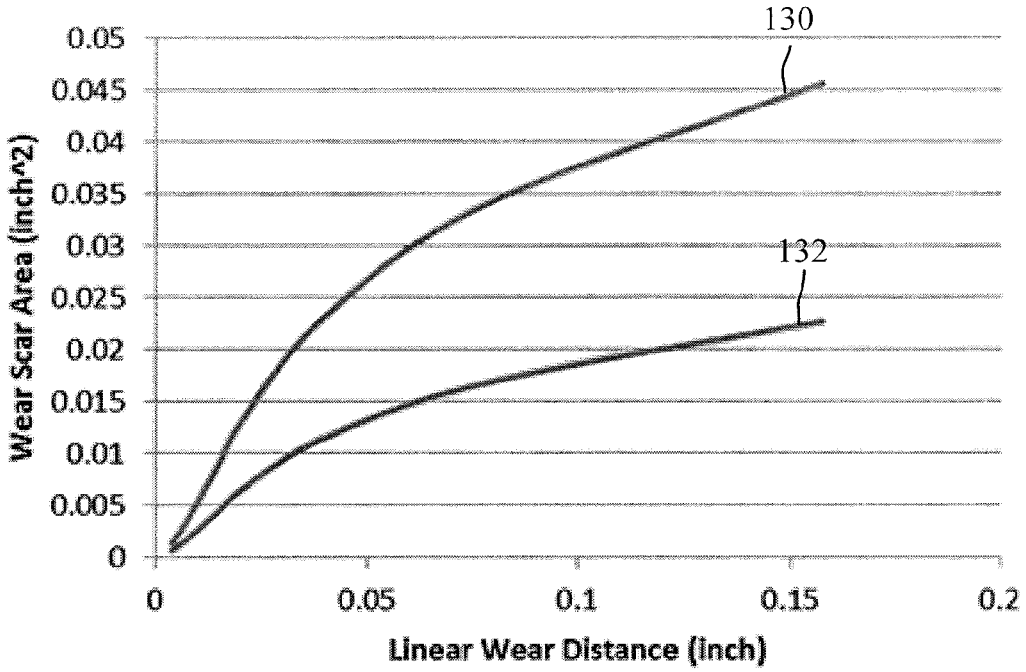
FIG. 6 is a simplified schematic diagram illustrating the manner in which the surface areas of wear scars of cutting elements according to embodiments of the present disclosure changes as a function of linear wear distance of the cutting elements relative to previously known cutting elements.

FIG. 6 is a graph including a first curve 130 representing how the area of a wear scar 122 may increase as a function of the linear wear distance for a previously known cutting element at a relatively high rate, and a second curve 132 representing how the area of a wear scar 122 of a cutting element 100 may increase as a function of the linear wear distance at a relatively low rate. The first curve 130 of FIG. 6 was generated using a model for a standard PDC cutting element having a diameter of ⅝ inch, a diamond table having a thickness of 2 mm, a 0.016 inch chamfer, and a 20° back rake angle. The second curve 132 was generated using a model for a PDC cutting element 100 as described herein having an average lateral length L of ⅝ inch, an average lateral width W of 5/16 inch, a curvature in the rounded lateral ends of about 3.2 inches, a diamond table having a thickness of 2 mm, a 0.016 inch chamfer, and a 20° back rake angle. As can be seen in FIG. 6, the wear scar area of the cutting element 100 may increase at a relatively lower rate compared to a previously known cutting element having a diameter equal to the average lateral length L of the cutting element 100. Further, as can be seen in FIG. 6, cutting elements 100 as described herein may be configured such that the wear scar area is only capable of reaching a maximum size, which may be smaller than a maximum size of a wear scar area for previously known cutting elements of comparable size. For example, a cutting element 100 as described herein may be configured to have an average lateral length L of about ⅝ inch, and may be configured such that the wear scar area is maintained at or below 25.8 $mm^2$ (0.04 $in^2$), or even at or below 19.4 $mm^2$ (0.03 $in^2$) even at linear wear distances greater than 2.54 mm (0.1 in), or even greater than 3.81 mm (0.15 in).

Additionally, for any given rotary drill bit or other type of earth-boring tool, the number of cutting elements 100 on the earth-boring tool may be selected such that, when the cutting elements 100 thereon become worn to the extent of having the maximum wear scar area, the cumulate wear scar area of all of the cutting elements 100 combined is sufficiently small to allow efficient drilling at an acceptable depth-of-cut without excessive weight-on-bit. Thus, the cutting elements 100 may wear in such a manner that continuous new cutting edges 106 are provided on the cutting elements 100. Additionally, the cutting elements (e.g., the substrate 104 and/or the superabrasive material 102) may be configured (in terms of material composition and geometrical configuration, location, and orientation) to wear or chip at a generally controlled rate.

In a configuration as described hereinabove, the drill bit or other earth-boring tool may not reach a dull state until the cutting elements 100 have worn to a greater extent compared to cutting elements on previously known drill bits and other earth-boring tools, and, in some embodiments, may not reach a dull state until the cutting elements 100 have worn at least substantially flush with the surrounding surfaces 117 of the body 116 to which they are mounted.

The cutting element 100 of FIGS. 1A and 1B has an oval geometry. Cutting elements having other laterally extended geometries are also within the scope of the present disclosure.

Figure 7A:
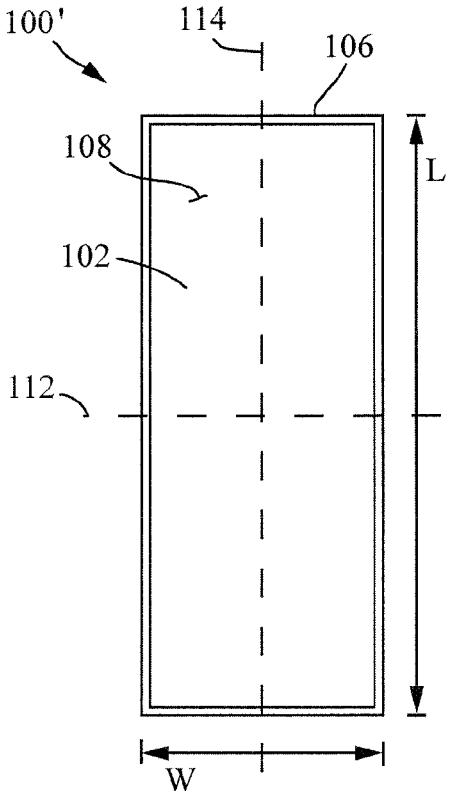
FIG. 7A is a front plan view of another embodiment of a cutting element.
Figure 7B:
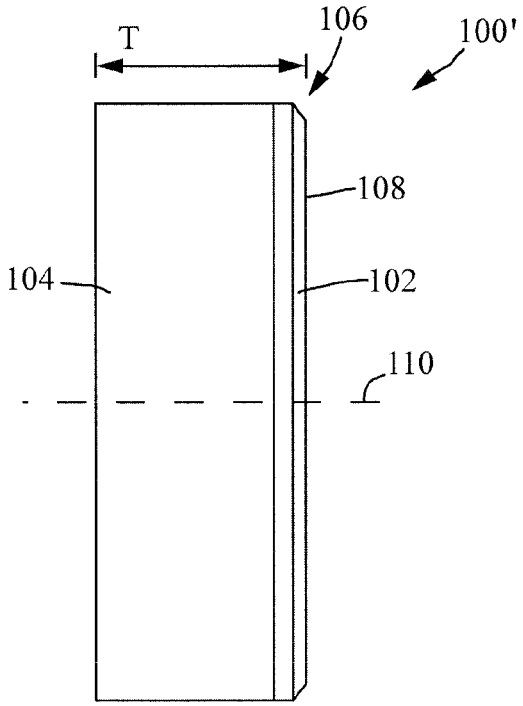
FIG. 7B is a side plan view of the cutting element of FIG. 7A.

FIGS. 7A and 7B illustrate another embodiment of a cutting element 100' having a rectangular geometry in the lateral dimensions. FIG. 7A is a front plan view of the cutting element 100', and FIG. 7B is a side plan view of the cutting element 100'. Like the cutting element 100 of FIGS. 1A and 1B, the cutting element 100' includes a volume of superabrasive material 102 that is formed on or attached to a substrate 104. A cutting edge 106 of the cutting element 100' is defined along a peripheral edge of a front cutting face 108 of the cutting element 100'. The cutting element 100' is elongated in a lateral dimension. In particular, the cutting element 100' has a maximum lateral width W in the lateral dimension parallel to the line 112 and a maximum lateral length L in the lateral dimension parallel to the line 114. As shown in FIG. 7A, the maximum lateral length L of the cutting element 100' is significantly greater than the maximum lateral width W of the cutting element 100'. Thus, the cutting element 100' is laterally extended (e.g., elongated) in the lateral dimension extending parallel to the line 114. In accordance with some embodiments, the cutting element 100' may have a maximum lateral length L that is at least about two (2) times greater than the maximum lateral width W of the cutting element 100', at least about three (3) times greater than the maximum lateral width W of the cutting element 100', or even at least about five (5) times greater than the maximum lateral width W of the cutting element 100'. As shown in FIG. 7B, the cutting element 100' also has a thickness T measured in dimensions parallel to the line 110 normal to the front cutting face 108 of the cutting element 100'. The thickness T may be less than the maximum lateral length L of the cutting element 100', and may be greater than, equal to, or less than the maximum lateral width W of the cutting element 100'.

As non-limiting example embodiments, the maximum lateral width W of the cutting element 100' may be between about five millimeters (5 mm) and about twenty millimeters (20 mm), between about five millimeters (5 mm) and about fifteen millimeters (15 mm), or even between about five millimeters (5 mm) and about ten millimeters (10 mm), and the maximum lateral length L of the cutting element 100' may be between about ten millimeters (10 mm) and about one hundred millimeters (100 mm). The thickness T of the cutting element 100' may be between about five millimeters (5 mm) and about twenty millimeters (20 mm).

Figure 8:
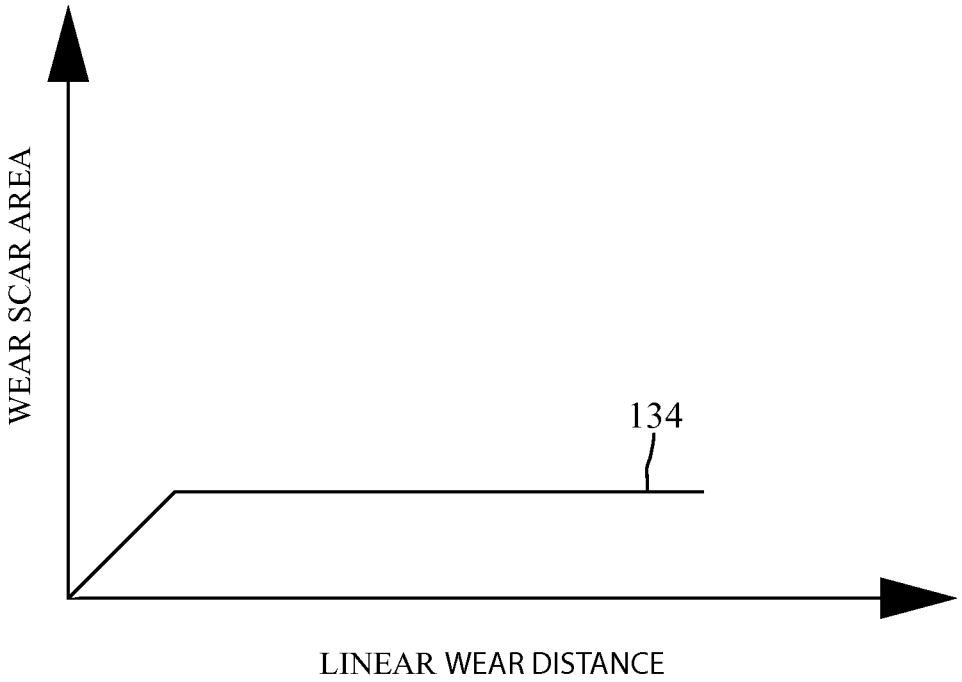
FIG. 8 is a simplified schematic diagram, like that of FIG. 6, illustrating how the surface areas of a wear scar of the cutting element of FIGS. 7A and 7B may change as a function of linear wear distance of the cutting element.

FIG. 8 is a simplified schematic graph like that of FIG. 6 including a curve 134 illustrating how the surface area of a wear scar of the cutting element 100' of FIGS. 7A and 7B may change as a function of linear wear distance of the cutting element 100' at a relatively lower rate compared to previously known cutting elements. As previously discussed in relation to FIG. 6, the cutting element 100' as described herein may be configured such that the wear scar area will reach a maximum size that is smaller than a maximum size of a wear scar area for previously known cutting elements of comparable size. In some embodiments, the wear scar area may be maintained at or below 25.8 $mm^2$ (0.04 $in^2$), or even at or below 19.4 $mm^2$ (0.03 $in^2$), even at linear wear distances greater than 2.54 mm (0.1 in), or even greater than 3.81 mm (0.15 in).

Figure 9A:
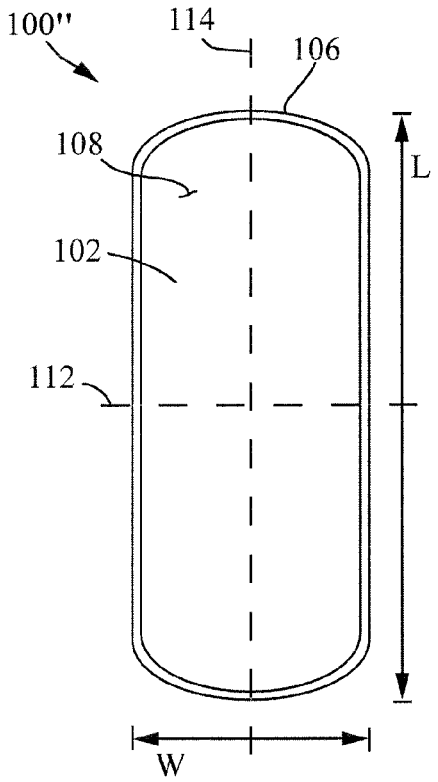
FIG. 9A is a front plan view of another embodiment of a cutting element.
Figure 9B:
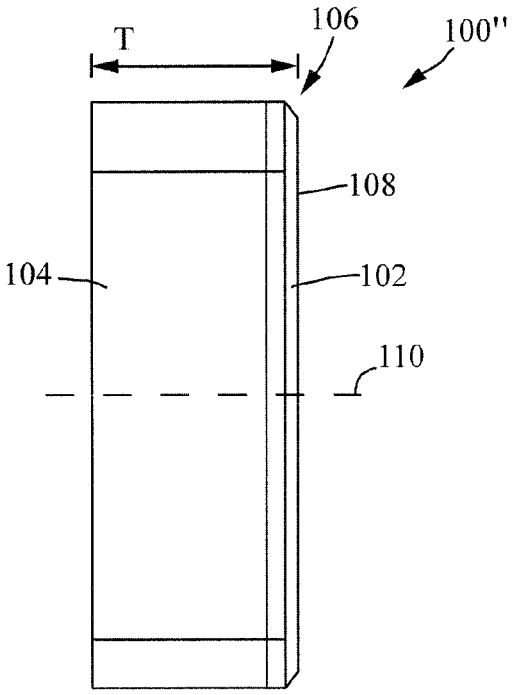
FIG. 9B is a side plan view of the cutting element of FIG. 9A.

FIGS. 9A and 9B illustrate another embodiment of a cutting element 100" having an elongated geometry in the lateral dimensions. In particular, the cutting element 100" includes two opposing planar lateral surfaces, and two opposing rounded lateral surfaces extending between the planar lateral surfaces, as shown in FIG. 9A. FIG. 9A is a front plan view of the cutting element 100", and FIG. 9B is a side plan view of the cutting element 100". The cutting element 100" includes a volume of superabrasive material 102 that is formed on or attached to a substrate 104. A cutting edge 106 of the cutting element 100" is defined along a peripheral edge of a front cutting face 108 of the cutting element 100". The cutting element 100" is elongated in a lateral dimension. In particular, the cutting element 100" has a maximum lateral width W in the lateral dimension parallel to the line 112 and a maximum lateral length L in the lateral dimension parallel to the line 114. As shown in FIG. 9A, the maximum lateral length L of the cutting element 100" is significantly greater than the maximum lateral width W of the cutting element 100". Thus, the cutting element 100" is laterally extended (e.g., elongated) in the lateral dimension extending parallel to the line 114. In accordance with some embodiments, the cutting element 100" may have a maximum lateral length L that is at least about two (2) times greater than the maximum lateral width W of the cutting element 100", at least about three (3) times greater than the maximum lateral width W of the cutting element 100", or even at least about five (5) times greater than the maximum lateral width W of the cutting element 100". As shown in FIG. 9B, the cutting element 100" also has a thickness T measured in dimensions parallel to the line 110 normal to the front cutting face 108 of the cutting element 100". The thickness T may be less than the maximum lateral length L of the cutting element 100", and may be greater than, equal to, or less than the maximum lateral width W of the cutting element 100".

As non-limiting example embodiments, the maximum lateral width W of the cutting element 100" may be between about five millimeters (5 mm) and about twenty millimeters (20 mm), between about five millimeters (5 mm) and about fifteen millimeters (15 mm), or even between about five millimeters (5 mm) and about ten millimeters (10 mm), and the maximum lateral length L of the cutting element 100" may be between about ten millimeters (10 mm) and about one hundred millimeters (100 mm). The thickness T of the cutting element 100" may be between about five millimeters (5 mm) and about twenty millimeters (20 mm).

Figure 10:
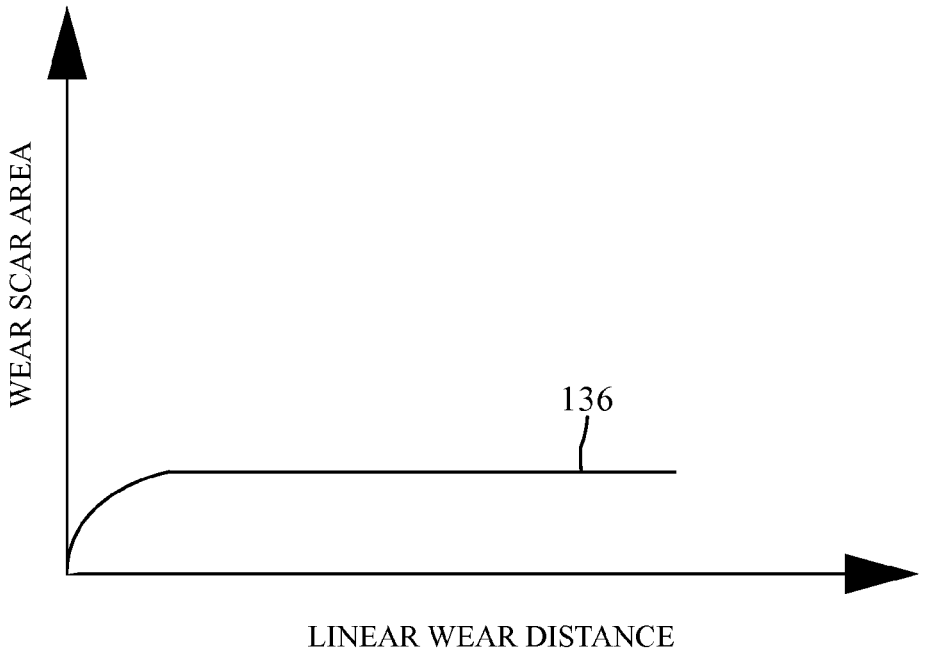
FIG. 10 is a simplified schematic diagram like those of FIG. 6 and FIG. 8 illustrating how the surface areas of a wear scar of the cutting element of FIGS. 9A and 9B may change as a function of linear wear distance of the cutting element.

FIG. 10 is a simplified schematic graph like that of FIG. 6 including a curve 136 illustrating how the surface area of a wear scar of the cutting element 100" of FIGS. 9A and 9B may change as a function of linear wear distance of the cutting element 100" at a relatively lower rate compared to previously known cutting elements. As previously discussed in relation to FIG. 6, the cutting element 100" as described herein may be configured such that the wear scar area will reach a maximum size that is smaller than a maximum size of a wear scar area for previously known cutting elements of comparable size. In some embodiments, the wear scar area may be maintained at or below 25.8 $mm^2$ (0.04 $in^2$), or even at or below 19.4 $mm^2$ (0.03 $in^2$), even at linear wear distances greater than 2.54 mm (0.1 in), or even greater than 3.81 mm (0.15 in).

Figure 11:
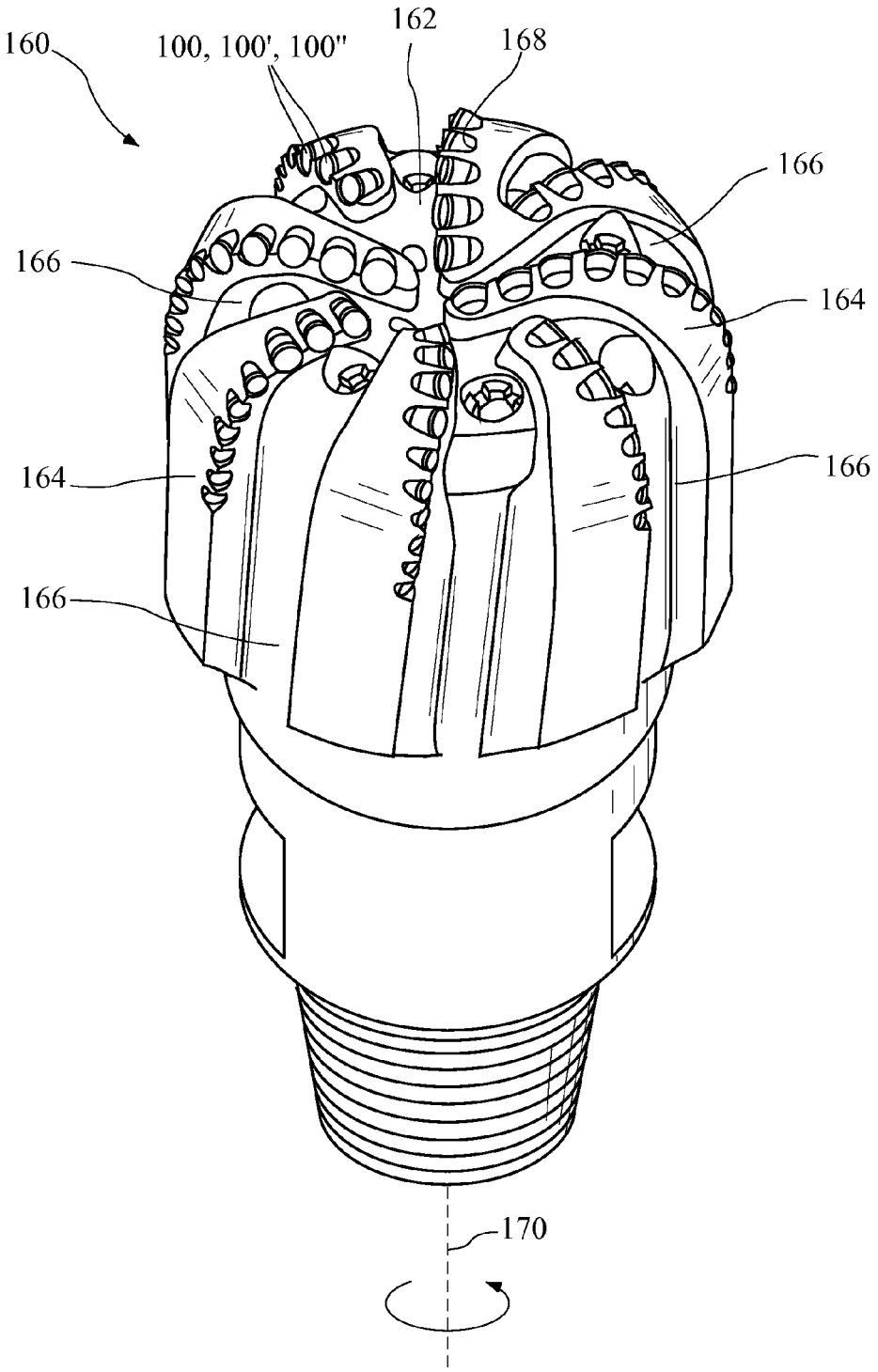
FIG. 11 illustrates an example embodiment of an earth-boring tool that may include cutting elements as described herein.

Embodiments of cutting elements 100, 100', 100" having an elongated lateral geometry as described herein may be mounted to earth-boring tools and used to remove subterranean formation material in accordance with additional embodiments of the present disclosure. FIG. 11 illustrates a fixed-cutter earth-boring rotary drill bit 160. The drill bit 160 includes a bit body 162. The bit body 162 may include a plurality of radially and longitudinally extending blades 164 that define fluid courses 166 therebetween. A plurality of cutting elements 100, 100', 100" as described herein may be mounted on the bit body 162 of the drill bit 160. For example, cutting elements 100, 100', 100" as described herein may be mounted to the blades 164 of the bit body 162 within pockets 168 formed in the blades 164 proximate rotationally leading sides of the blades 164. In this configuration, the drill bit 160 may be rotated and advanced into a subterranean formation. As the drill bit 160 is rotated about a rotational axis 170 within the wellbore, the cutting elements 100, 100', 100" cut away the formation material using a shearing mechanism to form the wellbore.

Cutting elements 100, 100', 100" as described herein may be employed on any other type of earth-boring tool, such as non-coring fixed-cutter rotary drill bits, reamers, etc.

Additional non-limiting examples of embodiments of the disclosure are set forth below.

Embodiment 1

A cutting element for an earth-boring tool, comprising: a substrate; and a volume of superabrasive material on an end of the substrate, an exposed surface of the superabrasive material defining a front cutting face of the cutting element; wherein the cutting element has an elongated shape in a lateral dimension parallel to the front cutting face of the cutting element, the cutting element having a maximum lateral width in a first direction parallel to the front cutting face of the cutting element, a maximum lateral length in a second direction parallel to the front cutting face of the cutting element, the second direction perpendicular to the first direction, the maximum lateral length being at least about two times the maximum lateral width.

Embodiment 2

The cutting element of Embodiment 1, wherein the volume of superabrasive material comprises polycrystalline diamond.

Embodiment 3

The cutting element of Embodiment 1 or Embodiment 2, wherein the front cutting face of the cutting element is planar.

Embodiment 4

The cutting element of any one of Embodiments 1 through 3, wherein the maximum lateral length is at least about three times the maximum lateral width.

Embodiment 5

The cutting element of Embodiment 4, wherein the maximum lateral length is at least about five times the maximum lateral width.

Embodiment 6

The cutting element of any one of Embodiments 1 through 5, wherein the maximum lateral width of the cutting element is between about five millimeters (5 mm) and about twenty millimeters (20 mm).

Embodiment 7

The cutting element of Embodiment 6, wherein the maximum lateral width of the cutting element is between about five millimeters (5 mm) and about fifteen millimeters (15 mm).

Embodiment 8

The cutting element of Embodiment 7, wherein the maximum lateral width of the cutting element is between about five millimeters (5 mm) and about ten millimeters (10 mm).

Embodiment 9

The cutting element of any one of Embodiments 1 through 8, wherein the maximum lateral length of the cutting element is between about ten millimeters (10 mm) and about one hundred millimeters (100 mm).

Embodiment 10

The cutting element of any one of Embodiments 1 through 9, wherein the cutting element is configured such that an area of a wear scar on the cutting element will be maintained below a predefined maximum wear scar area during use of the cutting element in an earth-boring operation.

Embodiment 11

The cutting element of any one of Embodiments 1 through 10, wherein the cutting element is configured such that an area of a wear scar on the cutting element will increase to a predefined maximum wear scar area during a first period of use of the cutting element in an earth-boring operation, and be maintained at the predefined maximum wear scar area during a following second period of use of the cutting element in the earth-boring operation.

Embodiment 12

The cutting element of any one of Embodiments 1 through 11, wherein the cutting element has an oval shape in a plane parallel to the front cutting face of the cutting element.

Embodiment 13

The cutting element of any one of Embodiments 1 through 11, wherein the cutting element has an rectangular shape in a plane parallel to the front cutting face of the cutting element.

Embodiment 14

An earth-boring tool, comprising: a body; and at least one cutting element mounted to the body, the at least one cutting element including a substrate and a volume of superabrasive material on an end of the substrate, an exposed surface of the superabrasive material defining a front cutting face of the at least one cutting element; wherein the at least one cutting element has an elongated shape in a lateral dimension parallel to the front cutting face of the at least one cutting element, the at least one cutting element having a maximum lateral width in a first direction parallel to the front cutting face of the at least one cutting element, a maximum lateral length in a second direction parallel to the front cutting face of the at least one cutting element, the second direction perpendicular to the first direction, the maximum lateral length being at least about two times the maximum lateral width.

Embodiment 15

The earth-boring tool of Embodiment 14, wherein the earth-boring tool comprises a fixed-cutter rotary drill bit.

Embodiment 16

The earth-boring tool of Embodiment 14 or Embodiment 15, wherein the at least one cutting element is oriented relative to the body such that the first direction in which the maximum lateral width extends is parallel to a surface of the body adjacent the at least one cutting element and such that the second direction in which the maximum lateral length extends is transverse to the surface of the body adjacent the at least one cutting element.

Embodiment 17

The earth-boring tool of any one of Embodiments 14 through 16, wherein the at least one cutting element is oriented at a back rake angle relative to the surface of the body adjacent the at least one cutting element.

Embodiment 18

A method of forming an earth-boring tool, comprising: selecting at least one cutting element including a substrate and a volume of superabrasive material on an end of the substrate, an exposed surface of the superabrasive material defining a front cutting face of the cutting element, the at least one cutting element having an elongated shape in a lateral dimension parallel to a front cutting face of the at least one cutting element, the at least one cutting element having a maximum lateral width in a first direction parallel to the front cutting face of the at least one cutting element, a maximum lateral length in a second direction parallel to the front cutting face of the at least one cutting element, the second direction perpendicular to the first direction, the maximum lateral length being at least about two times the maximum lateral width; and mounting the at least one cutting element to a body of the earth-boring tool.

Embodiment 19

The method of Embodiment 18, further comprising selecting the earth-boring tool to comprise a fixed-cutter rotary drill bit.

Embodiment 20

The method of Embodiment 18 or Embodiment 19, further comprising orienting the at least one cutting element relative to the body such that the first direction in which the maximum lateral width extends is parallel to a surface of the body adjacent the at least one cutting element and such that the second direction in which the maximum lateral length extends is transverse to the surface of the body adjacent the at least one cutting element.

Embodiment 21

A method of fabricating a cutting element as recited in any one of claims 1 through 13.

Although the foregoing description contains many specifics, these are not to be construed as limiting the scope of the present disclosure, but merely as providing certain embodiments. Similarly, other embodiments of the disclosure may be devised which do not depart from the scope of the present disclosure. For example, features described herein with reference to one embodiment also may be provided in others of the embodiments described herein. The scope of the invention is, therefore, indicated and limited only by the appended claims and their legal equivalents, rather than by the foregoing description. All additions, deletions, and modifications to the invention, as disclosed herein, which fall within the meaning and scope of the claims, are encompassed by the present invention.

What is claimed is:

1. A PDC cutting element for an earth-boring fixed-cutter rotary drill bit, comprising:

a substrate; and a volume of polycrystalline diamond material on an end of the substrate, an exposed surface of the volume of polycrystalline diamond material defining a front cutting face of the PDC cutting element;

wherein the PDC cutting element has an elongated shape in a lateral dimension parallel to the front cutting face of the PDC cutting element, the PDC cutting element having a maximum lateral width in a first direction parallel to the front cutting face of the PDC cutting element, a maximum lateral length in a second direction parallel to the front cutting face of the PDC cutting element, the second direction perpendicular to the first direction, the maximum lateral length being at least two times the maximum lateral width, wherein the PDC cutting element is configured such that an area of a wear scar on the PDC cutting element will be maintained below 22.6 $mm^2$ at a linear wear distance of 3.81 mm or less measured from an unworn cutting edge of the PDC cutting element in the second direction.

2. The PDC cutting element of claim 1, wherein the volume of polycrystalline diamond material comprises polycrystalline diamond.

3. The PDC cutting element of claim 1, wherein the front cutting face of the PDC cutting element is planar.

4. The PDC cutting element of claim 1, wherein the maximum lateral length is at least about three times the maximum lateral width.

5. The PDC cutting element of claim 4, wherein the maximum lateral length is at least about five times the maximum lateral width.

6. The PDC cutting element of claim 1, wherein the maximum lateral width of the PDC cutting element is between about five millimeters (5 mm) and about twenty millimeters (20 mm).

7. The PDC cutting element of claim 6, wherein the maximum lateral width of the PDC cutting element is between about five millimeters (5 mm) and about fifteen millimeters (15 mm).

8. The PDC cutting element of claim 7, wherein the maximum lateral width of the PDC cutting element is between about five millimeters (5 mm) and about ten millimeters (10 mm).

9. The PDC cutting element of claim 6, wherein the maximum lateral length of the PDC cutting element is between about ten millimeters (10 mm) and about one hundred millimeters (100 mm).

10. The PDC cutting element of claim 1, wherein the PDC cutting element is configured such that the area of the wear scar on the PDC cutting element will increase to a predefined maximum wear scar area during a first period of use of the PDC cutting element in an earth-boring operation, and be maintained at the predefined maximum wear scar area during a following second period of use of the PDC cutting element in the earth-boring operation.

11. The PDC cutting element of claim 1, wherein the PDC cutting element has an oval shape in a plane parallel to the front cutting face of the PDC cutting element.

12. The PDC cutting element of claim 1, wherein the PDC cutting element has a rectangular shape in a plane parallel to the front cutting face of the PDC cutting element.

13. A fixed-cutter earth-boring rotary drill bit, comprising:

a fixed-cutter bit body; and at least one PDC cutting element mounted to the fixed-cutter bit body, the at least one PDC cutting element including a substrate and a volume of polycrystalline diamond material on an end of the substrate, an exposed surface of the volume of polycrystalline diamond material defining a front cutting face of the at least one PDC cutting element;

wherein the at least one PDC cutting element has an elongated shape in a lateral dimension parallel to the front cutting face of the at least one PDC cutting element, the at least one PDC cutting element having a maximum lateral width in a first direction parallel to the front cutting face of the at least one PDC cutting element, a maximum lateral length in a second direction parallel to the front cutting face of the at least one PDC cutting element, the second direction perpendicular to the first direction, the maximum lateral length being at least two times the maximum lateral width, wherein the at least one PDC cutting element is configured such that an area of a wear scar on the at least one PDC cutting element will be maintained below 22.6 $mm^2$ at a linear wear distance of 3.81 mm or less measured from an unworn cutting edge of the at least one PDC cutting element in the second direction.

14. The fixed-cutter earth-boring rotary drill bit of claim 13, wherein the at least one PDC cutting element is oriented relative to the body such that the first direction in which the maximum lateral width extends is parallel to a surface of the fixed-cutter bit body adjacent the at least one PDC cutting element and such that the second direction in which the maximum lateral length extends is transverse to the surface of the fixed-cutter bit body adjacent the at least one PDC cutting element.

15. The fixed-cutter earth-boring rotary drill bit of claim 14, wherein the at least one PDC cutting element is oriented at a back rake angle relative to the surface of the fixed-cutter bit body adjacent the at least one PDC cutting element.

16. A method of forming a fixed cutter earth-boring rotary drill bit, comprising:

selecting at least one PDC cutting element including a substrate and a volume of polycrystalline diamond material on an end of the substrate, an exposed surface of the volume of polycrystalline diamond material defining a front cutting face of the PDC cutting element, the at least one PDC cutting element having an elongated shape in a lateral dimension parallel to a front cutting face of the at least one PDC cutting element, the at least one PDC cutting element having a maximum lateral width in a first direction parallel to the front cutting face of the at least one PDC cutting element, a maximum lateral length in a second direction parallel to the front cutting face of the at least one PDC cutting element, the second direction perpendicular to the first direction, the maximum lateral length being at least two times the maximum lateral width, wherein the at least one PDC cutting element is configured such that an area of a wear scar on the at least one PDC cutting element will be maintained below 22.6 $mm^2$ at a linear wear distance of 3.81 mm or less measured from an unworn cutting edge of the at least one PDC cutting element in the second direction; and mounting the at least one PDC cutting element to a body of the fixed-cutter earth-boring rotary drill bit.

17. The method of claim 16, further comprising orienting the at least one PDC cutting element relative to the body such that the first direction in which the maximum lateral width extends is parallel to a surface of the body adjacent the at least one PDC cutting element and such that the second direction in which the maximum lateral length extends is transverse to the surface of the body adjacent the at least one PDC cutting element.

* * * * *